US006154018A

United States Patent [19]

Sessions

[11] Patent Number: 6,154,018

[45] Date of Patent: Nov. 28, 2000

[54] HIGH DIFFERENTIAL IMPEDANCE LOAD DEVICE

[75] Inventor: D. C. Sessions, Phoenix, Ariz.

[73] Assignee: VLSI Technology, Inc., San Jose, Calif.

[21] Appl. No.: 09/388,034

[22] Filed: Sep. 1, 1999

[51] Int. Cl.[7] ..... G05F 3/16

[52] U.S. Cl. ..... 323/315

[58] Field of Search ..... 323/315, 312, 323/311, 313

[56] References Cited

PUBLICATIONS

Nakamura and Carley, "An enchanced fully differential folded cascode op amp", IEEE, pp. 563–567, Apr. 1992.

*Primary Examiner*—Shawn Riley

*Assistant Examiner*—Gary L. Laxton

*Attorney, Agent, or Firm*—Wagner, Murabito & Hao LLP

[57] ABSTRACT

A high differential impedance load device. The present invention recites a load device including a first lead, a second lead, a first current mirror, a second current mirror, and a third lead. First lead, second lead, and third lead are coupled to first current mirror and second current mirror such that a current sunk on first lead is approximately equal to a current sunk on second lead. Third lead represents a reference voltage which is ground.

20 Claims, 9 Drawing Sheets

200d

HIGH DIFFERENTIAL IMPEDANCE LOAD DEVICE

TECHNICAL FIELD

The present claimed invention relates to the field of semiconductor devices. Specifically, the present claimed invention relates to an apparatus and a method that provides a high differential impedance load.

BACKGROUND ART

A load device can be used to provide a voltage at the input node of the load device, corresponding to an unknown current level supplied to the load device. Similarly, a load device can be designed to provide this voltage level for an input current on each of two input leads. A load device with two input leads can be coupled downstream of a two-output differential amplifier, such as a differential transconductance amplifier. Additionally, a two-input load device can be configured to provide equivalent voltage levels for equivalent input current levels, e.g. common-mode operation, and to provide differential voltage levels for differential input current levels, e.g. differential-mode operation. These voltage levels generated by the load device can be subsequently processed by downstream devices, such as amplifiers.

A conventional load device with external control circuitry is shown in prior art FIG. 1A. Conventional load device 107 includes a first transistor 123 coupled to a first lead, lead A 103, and a second transistor 117 coupled to a second lead, lead B 105. Gate 123*a* for first transistor 123 and gate 117*a* for second transistor 117 are both coupled to a separate control, or bias, circuit 105. The conventional control circuit 105 shown in FIG. 1A uses a single transistor 111 to generate a voltage for gates 123*a* and 117*a* from a given input bias current IC 111. However, the prior art circuitry 105 used to bias the load device is external from the load device 107 and can be complicated. Furthermore, the actual level of the current supplied to the load device, e.g. current IA 141 for input lead A 103 and current IB 131 for input lead B 105, is not defined in most applications and can vary significantly. Because bias current IC 111 is not sensitive to the current level supplied to the load device, the biasing can result in undesirable qualities, such as variable operating point, as illustrated in a subsequent figure. Hence, a need arises for a load device that has a control circuit that is less complicated and is tied to the input current to the load device so as to better regulate the operating, or bias, point of the load device.

A graph of the differential impedance versus bias current for a conventional load device is shown in prior art FIG. 1B. The abscissa of graph 100*b* represents the bias current, shown in microamps, while the ordinate of graph 100*b* represents the differential impedance in kilo-ohms. Regarding prior art FIG. 1A, IC 111 represents the bias current, while input current IA 141 is equivalent to IC 111 plus differential current ΔI, and input current IB 131 is equivalent to IC 111 minus differential current ΔI. Consequently, the impedance for differential operation is equivalent to the change in differential voltage, $\Delta V_{A-B}$, measured between input lead A103 and input lead B 105, divided by the change in the differential current ΔI, e.g. $Z=[[\delta(\Delta V_{A-B}]/[\delta(\Delta I)]]$. Graph 100*b* represents the performance for a 10$\mu$ transistor width for each transistor in the load device 107 shown in prior art FIG. 1A. In differential-mode operation, the load device should produce different voltage levels on each input to a load device to reflect the different current levels being fed to the load device. The differential impedance of the load device is the mechanism that generates the differential voltage. The greater the differential voltage, the greater the gain of the system. For improved performance, a need arises for a load device with higher differential impedance.

One prior art load device provided differential impedance by making a gate of one of its transistors sensitive to the input voltage. However, this prior art configuration generated a voltage mismatch because the current levels consumed by the load device for each of the two input leads were different. The first lead had a current different from the second lead because it was the only lead that supplied current to specific types of components within the load device. Thus, this configuration did not provide both the true and complementary versions of the differential voltage levels which are very useful to downstream circuitry. Consequently, a need arises for a load device that has true current matching on both inputs, thereby preserving both the true and complement versions of the voltage differential.

A graph of the common-mode impedance vs. bias current for a conventional load device is shown in prior art FIG. 1C. Graph 100*c* represents the performance for a 10$\mu$ transistor width for each transistor in the load device 107 shown in prior art FIG. 1A. In common-mode operation, the load device should yield an equivalent voltage on the two inputs of the load device to reflect the equal current being fed to the two inputs. The abscissa of graph 100*c* represents the bias current, shown in microamps, while the ordinate of graph 100*c* represents the common-mode impedance in kilo-ohms. Referring to prior art FIG. 1A, IC 111 represents the bias current, while input current IA 141 is equivalent to IC 111 plus differential current ΔI, and input current IB 131 is also equivalent to IC 111 plus differential current ΔI. Consequently, the impedance for common-mode operation is equivalent to the change in voltage, V, for either lead A 103 or lead B 105, divided by the change in the differential current, e.g. $Z=[[\delta V_A]/[\delta(\Delta I)]]$.

The common-mode impedance of a conventional load device is excessively high, due partially to the conventional external biasing, such as that shown in prior art FIG. 1A. The external biasing on input leads 103 and 105 translates into a large change in the drain-to-source voltage, $V_{DS}$, of the transistors in the load device 107 given a small increase or decrease from the saturation-level of current on input lead A 103 and input lead B 105. Consequently, the voltage level, generated by the load device for the two inputs, varies significantly, albeit evenly, for common-mode input currents. However, a large variation in voltage levels for common mode input might require downstream hardware to be more robust, and hence more costly. Thus, a need arises for a load device that will regulate its loading based on the voltage of the inputs to the load device, so as to provide a narrow range of voltage levels for common-mode operation.

One prior art solution to wide voltage ranges for common-mode operation, uses a voltage-sensitive device, such as a resistor or a diode, to limit the voltage swing. However, by using a voltage-sensitive device, the gain of the load device is compromised. As a result, a need arises for a load device that maintains a maximum gain while providing a voltage-sensitive load device having a stable operating point, and thus reasonably small variations in output voltage for common-mode operation.

In summary, a need arises for a load device with a control circuit that is less complicated and is tied to the input current of the load device so as to better regulate the operating, or bias, point of the load device. Additionally, for improved performance, a need arises for a load device with higher differential impedance. Furthermore, a need arises for a load device that has true current matching on both inputs, thereby preserving both the true and complement versions of the voltage differential. A need also arises for a load device that will regulate its loading based on the voltage of the inputs to the load device, so as to provide a narrow range of voltage levels for common mode operation. Also, a need arises for a load device that maintains a maximum gain while providing a voltage-sensitive load device having a stable operating point.

DISCLOSURE OF THE INVENTION

The present invention provides a method and apparatus for providing a high differential impedance load device.

In one embodiment, the present invention recites a load device including a first lead, a second lead, a first current mirror, a second current mirror, and a third lead. The first lead, the second lead, and the third lead are coupled to the first and second current mirror such that a current sunk on the first lead is approximately equal to the current sunk on the second lead. The third lead represents a reference voltage which is ground in one embodiment. By sinking an equal amount of current on both first and second leads, the present invention provides a load device that provides both true and complement versions of the voltage differential for differential mode operation.

Both first and second current mirrors of the present embodiment include at least one diode connected device. The diode connected devices provide regulation for both the first and second current mirror. As a result, the present invention provides maximum gain while providing a voltage-sensitive load device having a stable operating point, and reasonably small variations in output voltage for common-mode operation.

In another embodiment, the present invention recites a method for providing a high differential impedance load. A first signal and a second signal, each having a current level, are received. The first total current and the second total current are each divided into a first portion and a second portion. The first portion and second portion of each total current equal each respective total current, in one embodiment. Subsequently, the first current mirror sinks the first portion of the first total current and the first portion of the second total current. Similarly, the second current mirror sinks the second portion of the first total current and the second portion of the second total current. Then, a first voltage is generated on the first lead, based on the first total current, the second total current, the operating point of the first current mirror, and the operating point of the second current mirror. Similarly, a second voltage is generated on the second lead, based on the first total current, the second total current, the operating point of the first current mirror, and the operating point of the second current mirror. Then, an operating point for both the first and second current mirror is established, or updated, by the first voltage and the second voltage. By having the voltage level on both first and second lead reliant upon the current level on both the first and second lead, the present invention provides matching current capability with high differential impedance. Consequently, the present invention provides a load device with self-regulation and a very stable operating point.

These and other objects and advantages of the present invention will no doubt become obvious to those of ordinary skill in the art after having read the following detailed description of the preferred embodiments illustrated in the various drawing figures.

BRIEF DESCRIPTION OF THE DRAWINGS

The accompanying drawings, which are incorporated in and form part of this specification, illustrate embodiments of the invention and, together with the description, serve to explain the principles of the invention.

PRIOR ART

PRIOR ART

PRIOR ART

Figure 1A:
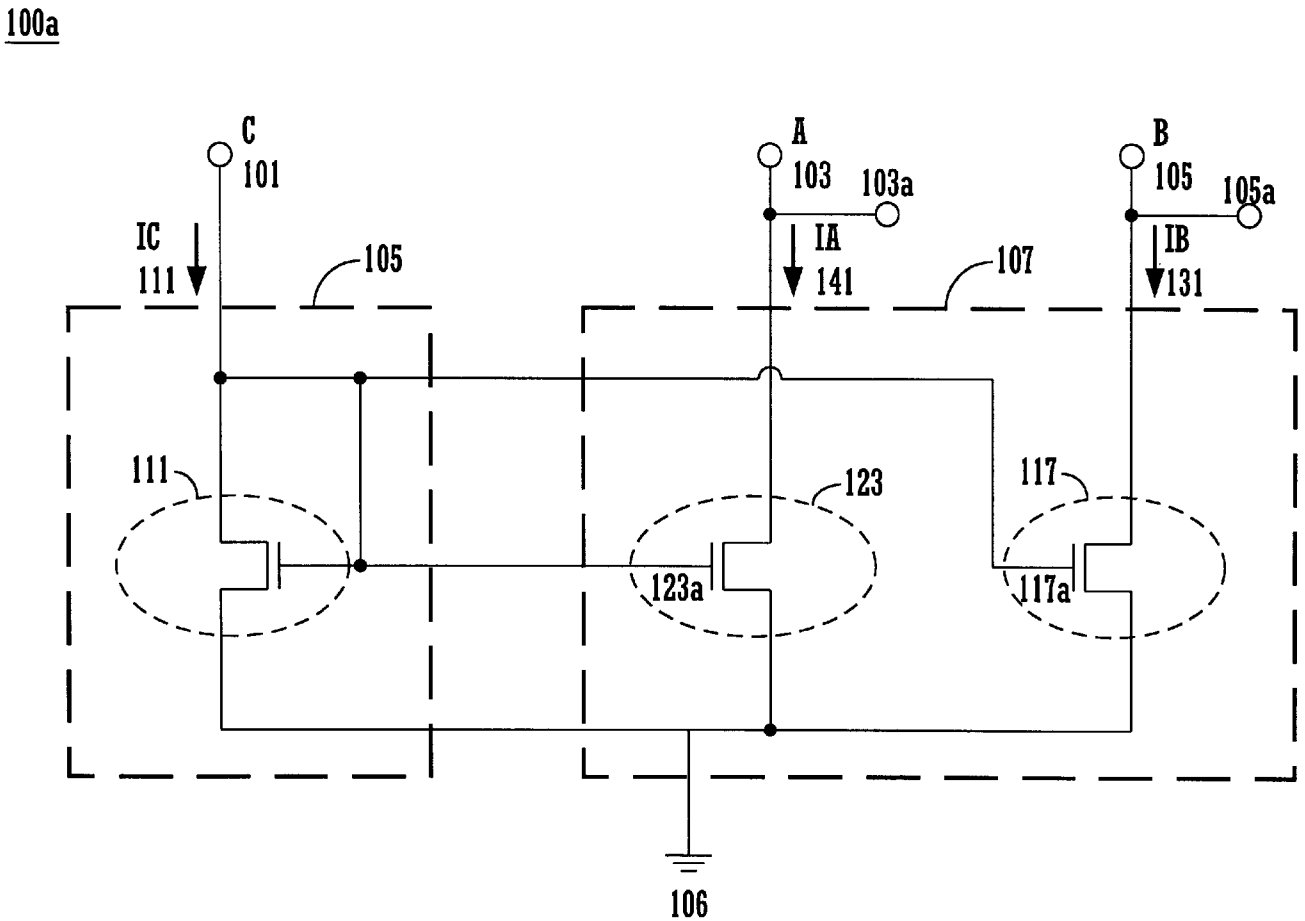
FIGURE 1A (Prior Art)
FIG. 1A is an electrical schematic of a conventional load device with external control circuitry.

The drawings referred to in this description should be understood as not being drawn to scale except as specifically noted.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention can be practiced without these specific details. In other instances, well-known methods, procedures, components, and circuits have not been described in detail as not to unnecessarily obscure aspects of the present invention.

Some portions of the detailed descriptions which follow, e.g. the processes, are presented in terms of procedures, logic blocks, processing, and other symbolic representations of operations on electrical signals within an electrical circuit. These descriptions and representations are the means used by those skilled in the electrical design art to most effectively convey the substance of their work to others skilled in the art. A procedure, logic block, process, etc., is herein, and generally, conceived to be a self-consistent sequence of steps or instructions leading to a desired result. The steps are those requiring physical manipulations of physical quantities. Usually, though not necessarily, these physical manipulations take the form of electrical or magnetic signals capable of being stored, transferred, combined, compared, and otherwise manipulated in an electrical circuit. For reasons of convenience, and with reference to common usage, these signals are referred to as values, elements, symbols, characters, terms, numbers, or the like with reference to the present invention.

It should be borne in mind, however, that all of these terms are to be interpreted as referencing physical manipulations and quantities and are merely convenient labels and are to be interpreted further in view of terms commonly used in the art. Unless specifically stated otherwise as apparent from the following discussions, it is understood that throughout discussions of the present invention, terms such as or "receiving," "sinking," "generating," "establishing," "dividing," or the like, refer to the action and processes of an electrical circuit, or similar electronic device, that manipulates and transforms electrical signals. The current and voltage levels of signals represent physical quantities within a circuit that are transformed into other signals.

Figure 2A:
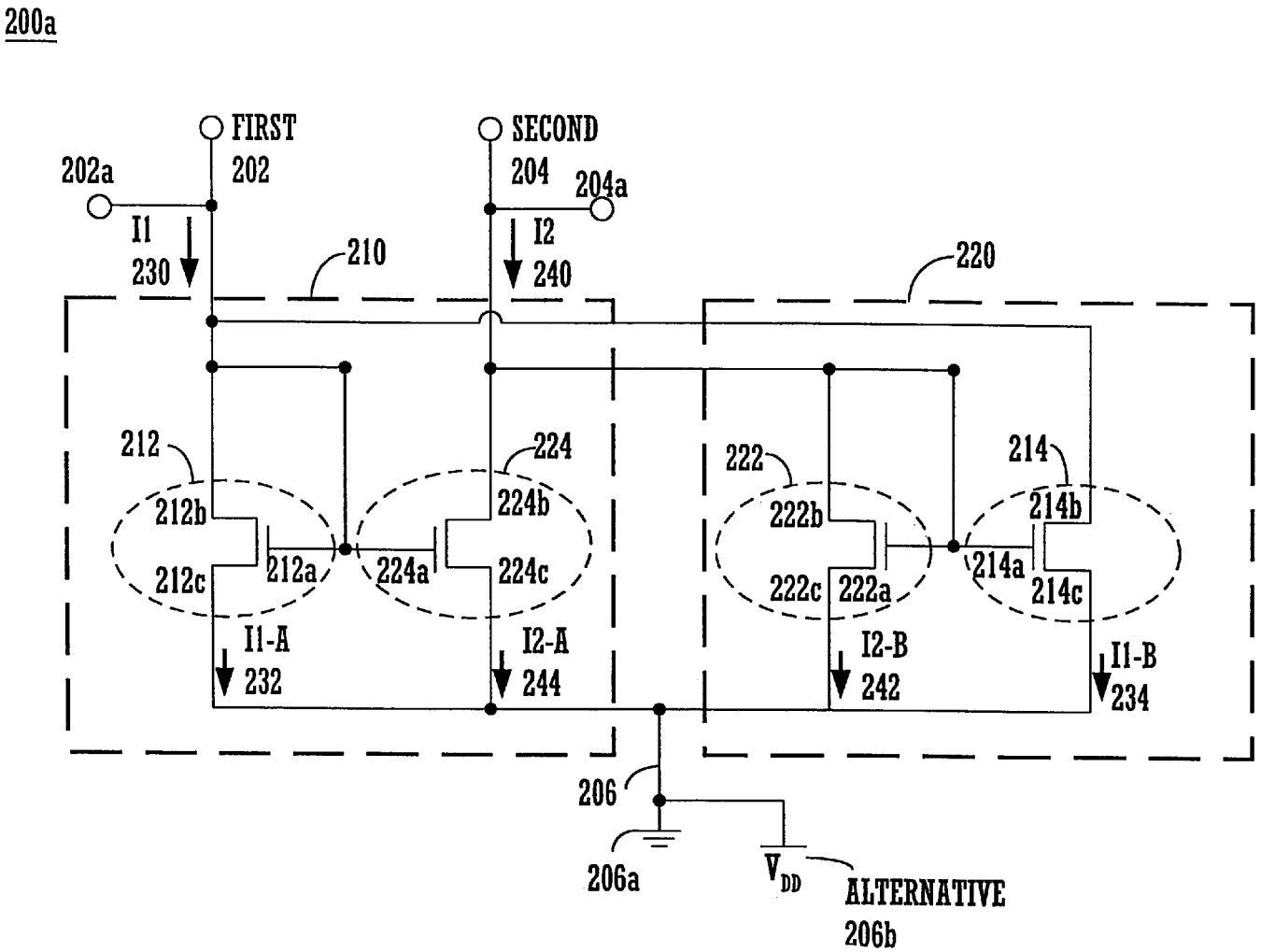
FIG. 2A is an electrical schematic of a high differential impedance load device, in accordance with one aspect of the present invention.

A high differential impedance load device assembly is shown in FIG. 2A, in accordance with one aspect of the present invention. Load device 200*a* includes a first lead 202 coupled to a first load device 210 and a second lead 204 coupled to a second load device 220. In one embodiment, first load device 210 is a first current mirror and second load device 220 is a second current mirror. In another embodiment, first load device 210 and second load device 220 can be an alternative device that accomplishes the function of the present invention. First current mirror 210 and second current mirror 220 are coupled to each other and are coupled to a third lead 206. In the present embodiment, third lead 206 is coupled to group 206*a*. However, the present invention is well-suited to coupling third lead 206 to a non-zero voltage source, such as a power supply 206*b*, or to another circuit.

In one embodiment, first current mirror 210 includes a first transistor 212 and a second transistor 224. First transistor 212 includes a gate 212*a* coupled to a drain 212*b* and a source 212*c*. Similarly second transistor 224 includes a gate 224*a* coupled to a drain 224*b* and a source 224*c*. Drain 212*b* of first transistor 212 is coupled to first lead 202, while drain 224*b* of second transistor 224 is coupled to second lead 204. Source 212*c* of first transistor 212 and source 224*c* of second transistor 224 are coupled to third lead 206. Gate 212*a* of first transistor 212 and gate 224*a* of second transistor 224 are coupled to first lead 202. In one embodiment, first transistor 212 of first load device 210 acts as a diode device by having its gate 212*a* coupled to its drain 212*b*. A diode device can also be referred to as a 'diode coupled device,' or as a 'diode transistor device.'

In the present embodiment, second current mirror 220 includes a first transistor 222 and a second transistor 214. First transistor 222 includes a gate 222*a* coupled to a drain 222*b* and a source 222*c*. Similarly, second transistor 214 includes a gate 214*a* coupled to a drain 214*b* and a source 214*c*. Drain 222*b* of first transistor 222 is coupled to second lead 204, while drain 214*b* of second transistor 214 is coupled to first lead 202. Source 222*c* of first transistor 222 and source 214*c* of second transistor 214 are coupled to third lead 206. Gate 222*a* of first transistor 222 and gate 214*a* of second transistor 214 are coupled to second lead 204. In one embodiment, first transistor 222 in second load device 220 acts as a diode coupled device by having its gate 222*a* coupled to its drain 222*b*. First and second current mirror, with the appropriate coupling to first, second, and third lead, provide a load device with elegant control circuitry that effectively and efficiently regulates the operating, or bias, point of load device 200*a*. The present embodiment also provides a load device that is sensitive to operating point voltage.

FIG. 2A also includes a first output lead 202*a* and a second output lead 204*a*. First output lead 202*a* is coupled to first lead 202 while second output lead 204*a* is coupled to second output lead 204. From each of these output leads, 202*a* and 204*a*, a voltage can be sensed for some other device, not shown in FIG. 2A. While the embodiment of FIG. 2A shows output leads 202*a* and 204*a* as part of load device 200*a*, the present invention does not require these leads. Instead, voltage can be sensed at some other point, such as the device that sourced the current to the load device 200*a*.

While the present embodiment of FIG. 2A shows transistors 212, 214, 222, and 224 are configured as a n-channel metal oxide semiconductors (NMOS), the present invention is suitable to a wide range of transistor configurations. For example, the present invention is well-suited to using different construction transistors, such as a junction field effect transistor (JFET) or a metal oxide semiconductor field effect transistor (MOSFET). Also, the present invention is suitable to using different configurations of transistors, such as depletion mode or enhancement mode transistors, or PMOS transistors, with the appropriate elements necessary to compensate for the polarity or bias difference. Additionally, the present invention is well-suited to using additional components in the circuit besides those shown in FIG. 2A. For example, a set of cascaded transistors, as shown in the following FIG. 2B, can be substituted for the transistors shown in the embodiment of FIG. 2A. Additionally, other electronic devices, such as resistors, can be used to enhance circuit operation. For example, a resistor can be coupled to the source of a transistor in order to bias the transistor.

The top electrodes of NMOS transistors of FIG. 2A are identified as the drain because they are more positive than the lower electrode of the transistors. The top electrodes are more positive because of the voltage levels assumed for the load device. However, the identification of the electrodes can be reversed, given alternative voltage levels in the device. Hence, the electrode labels of 'drain' and 'source' are interchangeable depending upon the voltage levels.

Figure 2B:
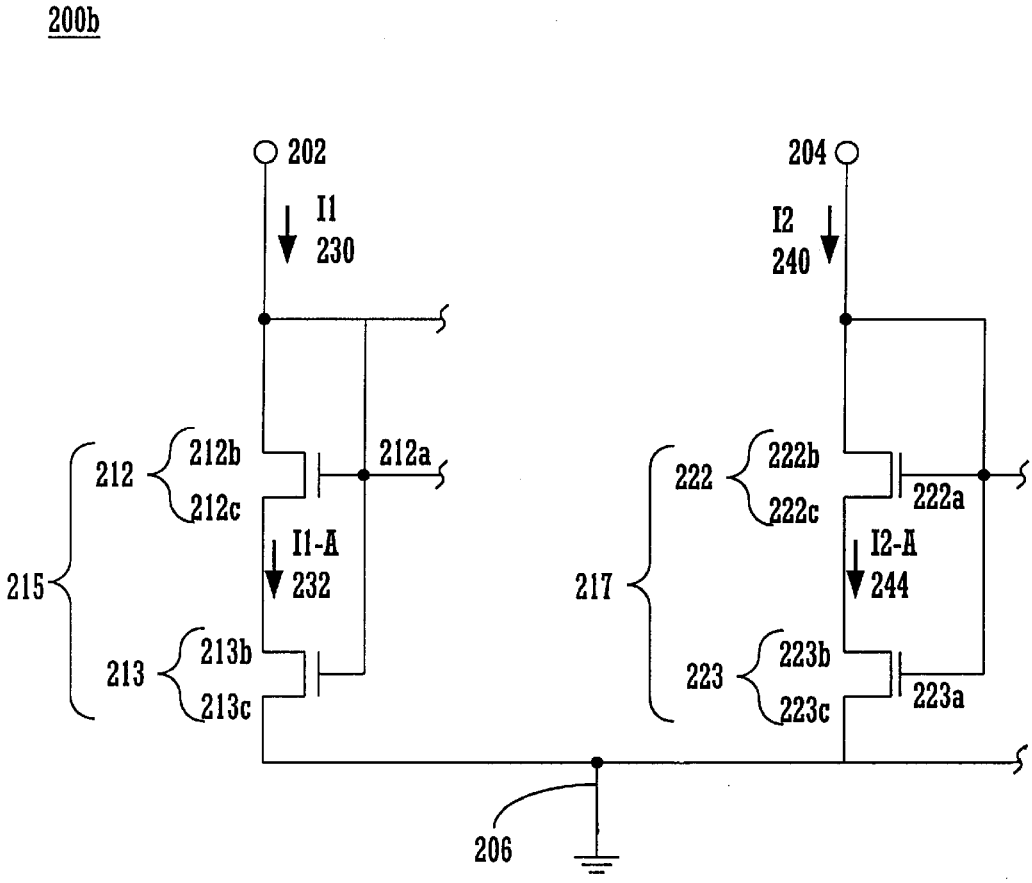
FIG. 2B is an electrical schematic of a portion of the high differential impedance load device of FIG. 2A with cascaded transistors, in accordance with one aspect of the present invention.

Part of high differential impedance load device 200*a* of FIG. 2A is shown in FIG. 2B using a set of cascaded transistors in lieu of a single transistor, in accordance with one aspect of the present invention. For clarity, FIG. 2B only shows only shows one situation in each load device where a single transistor of FIG. 2A is replaced with a set of cascaded transistors. FIG. 2B adds a second transistor 213 in series with original transistor 212, from FIG. 2A, to form a cascaded pair of transistors 215 for first load device. Transistor 213 has a drain 213*b* coupled to source 212*c* of transistor 212. Similar to transistor 212, gate 213*a* of transistor 213 is coupled to first lead 202. Source 213*c* of transistor 213 is coupled to third lead 206. FIG. 2B also adds a second transistor 223 in series with original transistor 222, from FIG. 2A, to form a cascaded pair of transistors 225 for second load device. Transistor 223 has a drain 223*b* coupled to source 222*c* of transistor 222. Similar to transistor 222, gate 223*a* of transistor 223 is coupled to second lead 204. Source 223*c* of transistor 223 is coupled to third lead 206. Cascaded transistors increase the quantity of components in the circuit, but they can also generate faster response and additional impedance.

While the present embodiment only shows one example of a cascaded pair of transistors, the present invention is well-suited to using a set of cascaded transistors for all of the single transistors shown in FIG. 2A. Similarly, a host of additional electronic components can be added to a load device with cascaded transistors. For example, one embodiment couples a resistive device with a cascaded pair of transistors.

Figure 1B:
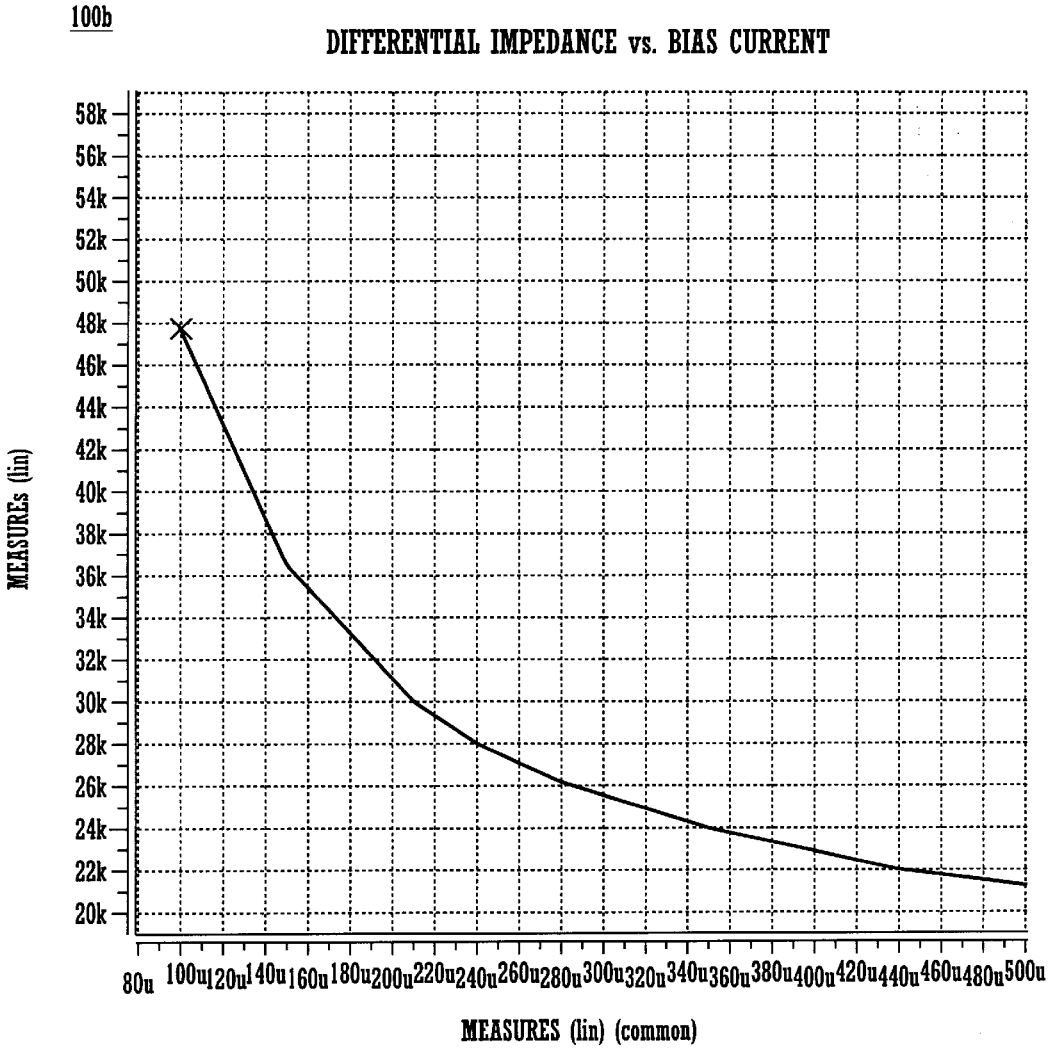
FIGURE 1B (Prior Art)
FIG. 1B is a graph of the differential impedance vs. bias current for a conventional load device.
Figure 2C:
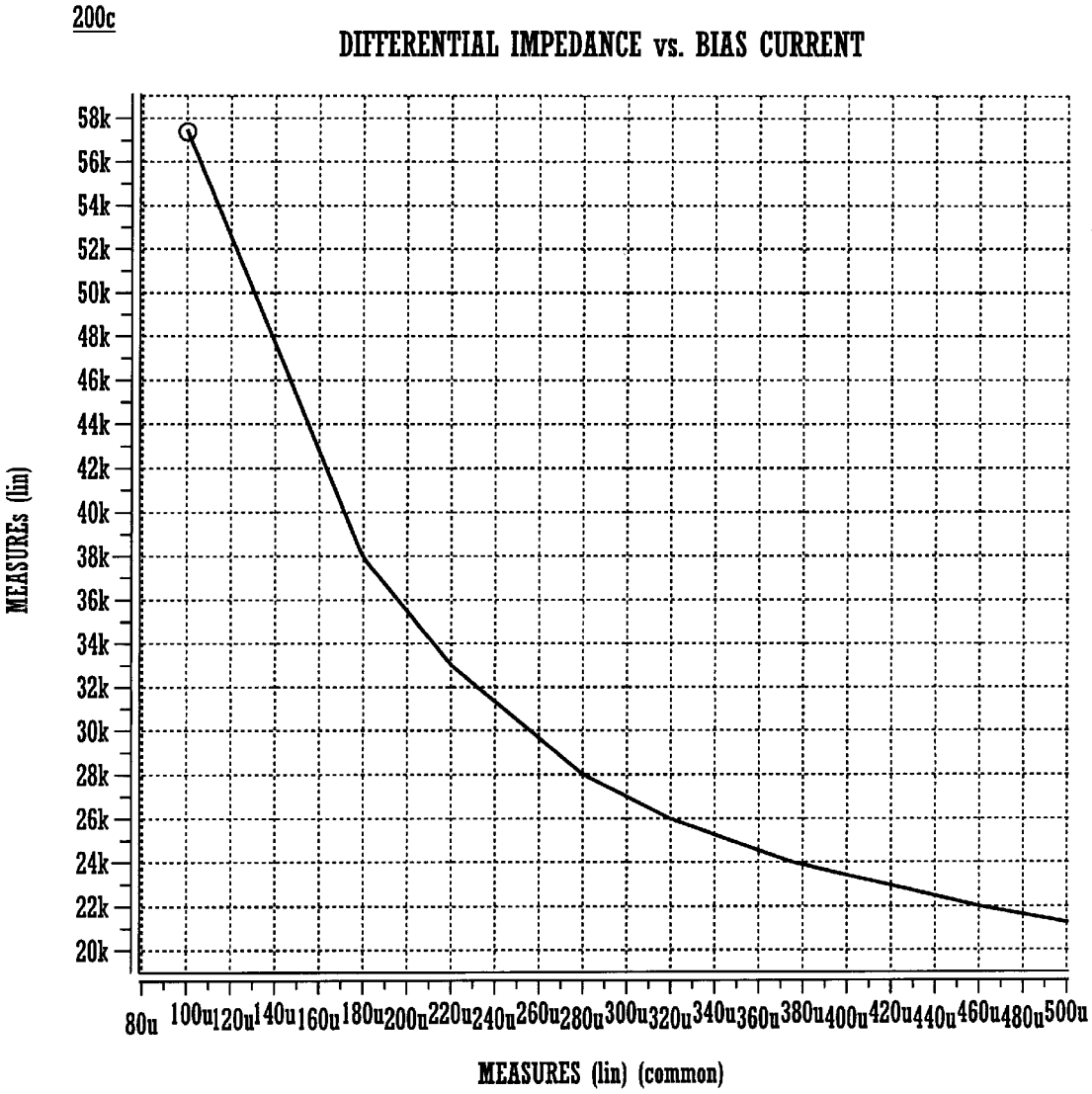
FIG. 2C is a graph of the differential impedance vs. bias current for the high differential impedance load device, in accordance with one aspect of the present invention.

A graph of the differential impedance versus bias current for the high-differential impedance load device is shown in FIG. 2C, in accordance with one aspect of the present invention. The abscissa of graph 200*c* represents the bias current, shown in microamps, while the ordinate of graph 200*c* represents the differential impedance in kilo-ohms. Graph 200*c* represents the performance for a 5$\mu$ transistor width for each of the two transistors in each current mirror shown in FIG. 2A. Thus, graph 200*c* presents a fair comparison against the prior art shown in prior art FIG. 1A and prior art FIG. 1B. However, graph 200*c* shows an approximately 10% higher differential impedance over the prior art for a given bias current. Hence, the present invention provides a load device with a higher differential impedance than the conventional level. For differential operation, input current I1 230 is equivalent to a bias current $I_B$ plus a differential current, $\Delta I$, while input current I2 240 is equivalent to the same bias current $I_B$ minus a differential current, $\Delta I$. Consequently, the impedance for differential operation is equivalent to the rate of change in differential voltage, $\Delta V_{1-2}$, measured between lead 1 202 and lead 2 204, divided by the change in the differential current, e.g. $Z=[[\delta(\Delta V_{1-2})]/[\delta(\Delta I)]]$.

Figure 1C:
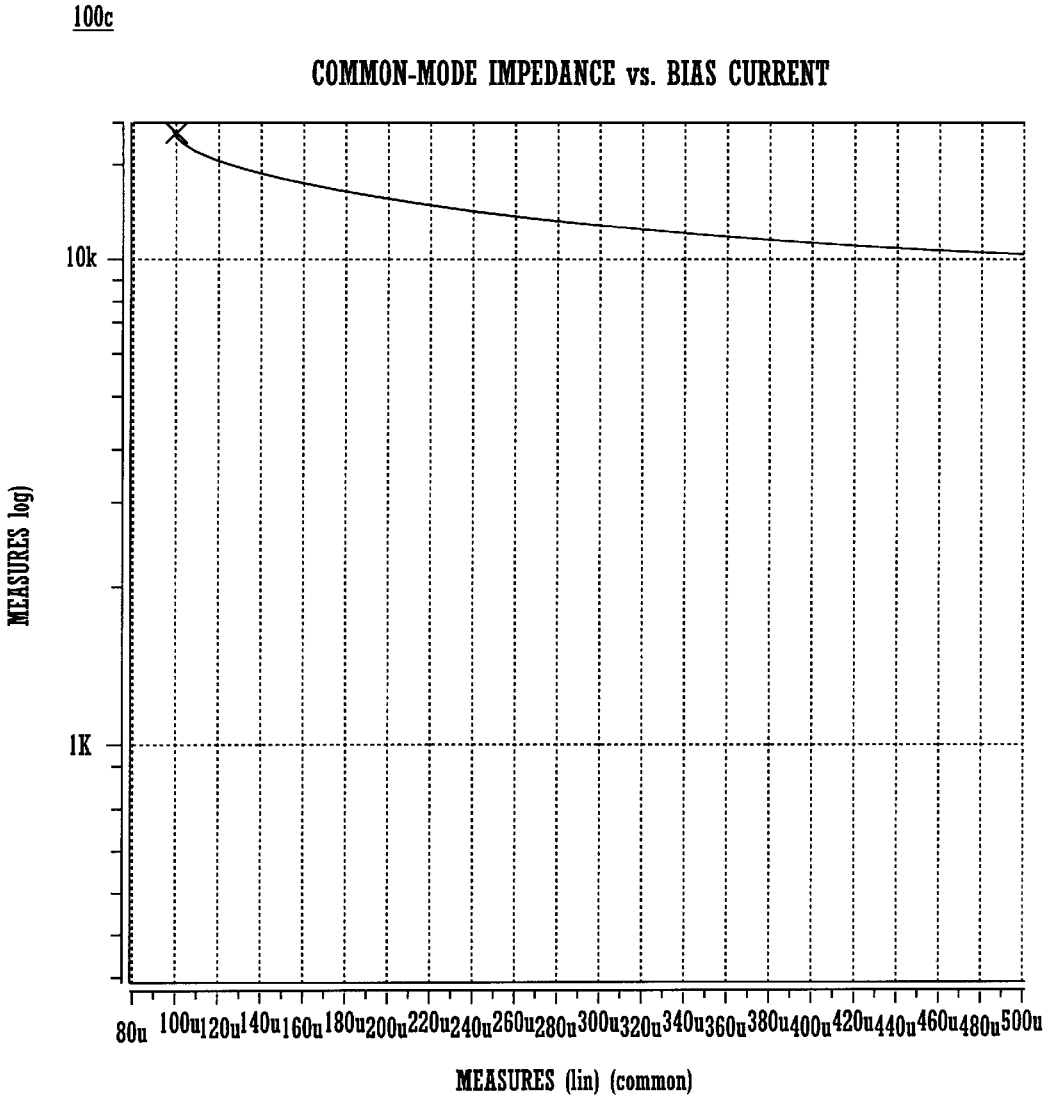
FIGURE 1C (Prior Art)
FIG. 1C is a graph of the common-mode impedance vs. bias current for a conventional load device.
Figure 2D:
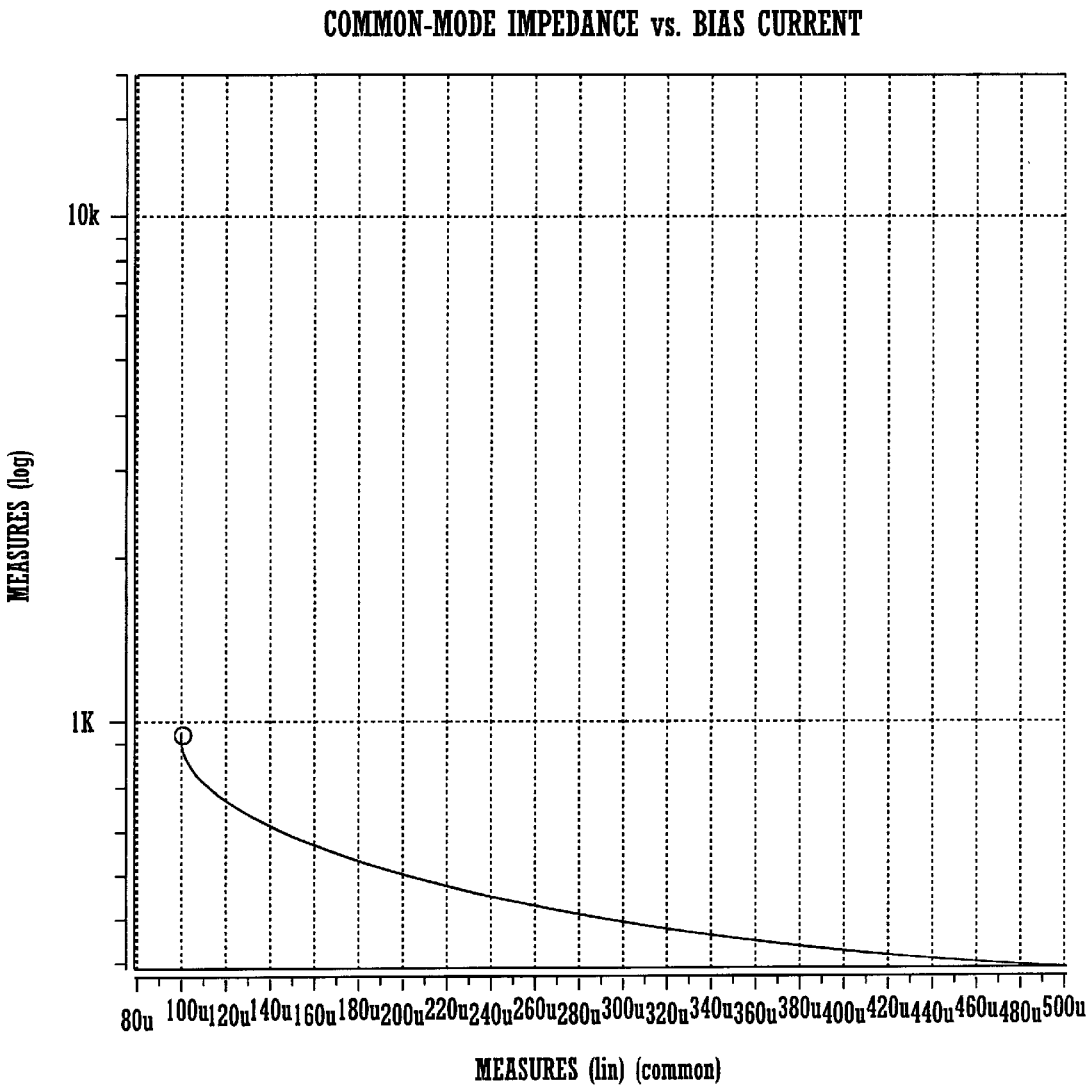
FIG. 2D is a graph of the common-mode impedance vs. bias current for the high differential impedance load device, in accordance with one aspect of the present invention.

A graph of the common-mode impedance vs. bias current for a high differential-impedance load device is shown in FIG. 2D, in accordance with one aspect of the present invention. The abscissa of graph 200*d* represents the bias current, shown in microamps, while the ordinate of graph 200*d* represents the common-mode impedance in kilo-ohms. For common-mode operation, input current I1 230 is equivalent to a bias current $I_B$ plus a differential current, $\Delta I$, and input current I2 240 is also equivalent to the same bias current $I_B$ plus a differential current, $\Delta I$. Consequently, the impedance for common-mode operation is equivalent to the change in voltage, $V_1$ or $V_2$, sensed on either lead 1 202 or lead 2 204 respectively, divided by the change in the differential current, e.g. $Z=[[\delta(V_1)]/[\delta(\Delta I)]]$. Graph 200*d* represents the performance for a 5$\mu$ transistor width for each of the two transistors in each current mirror shown in FIG. 2A. Thus, graph 200*d* presents a fair comparison against the prior art configuration shown in prior art FIG. 1A with its associated performance curve in prior art FIG. 1C. By using internal biasing, as shown in FIG. 2A for one embodiment, the present invention regulates loading based on the voltage at the leads of the load device. The common-mode impedance, as shown in graph 200*d*, for one embodiment of the present invention provides at least an order of magnitude less impedance than the common-mode impedance for a prior art device, as shown in graph 100*c*. Consequently, the present invention provides a load device with a narrow range of operating voltages for common-mode operation.

Figure 3:
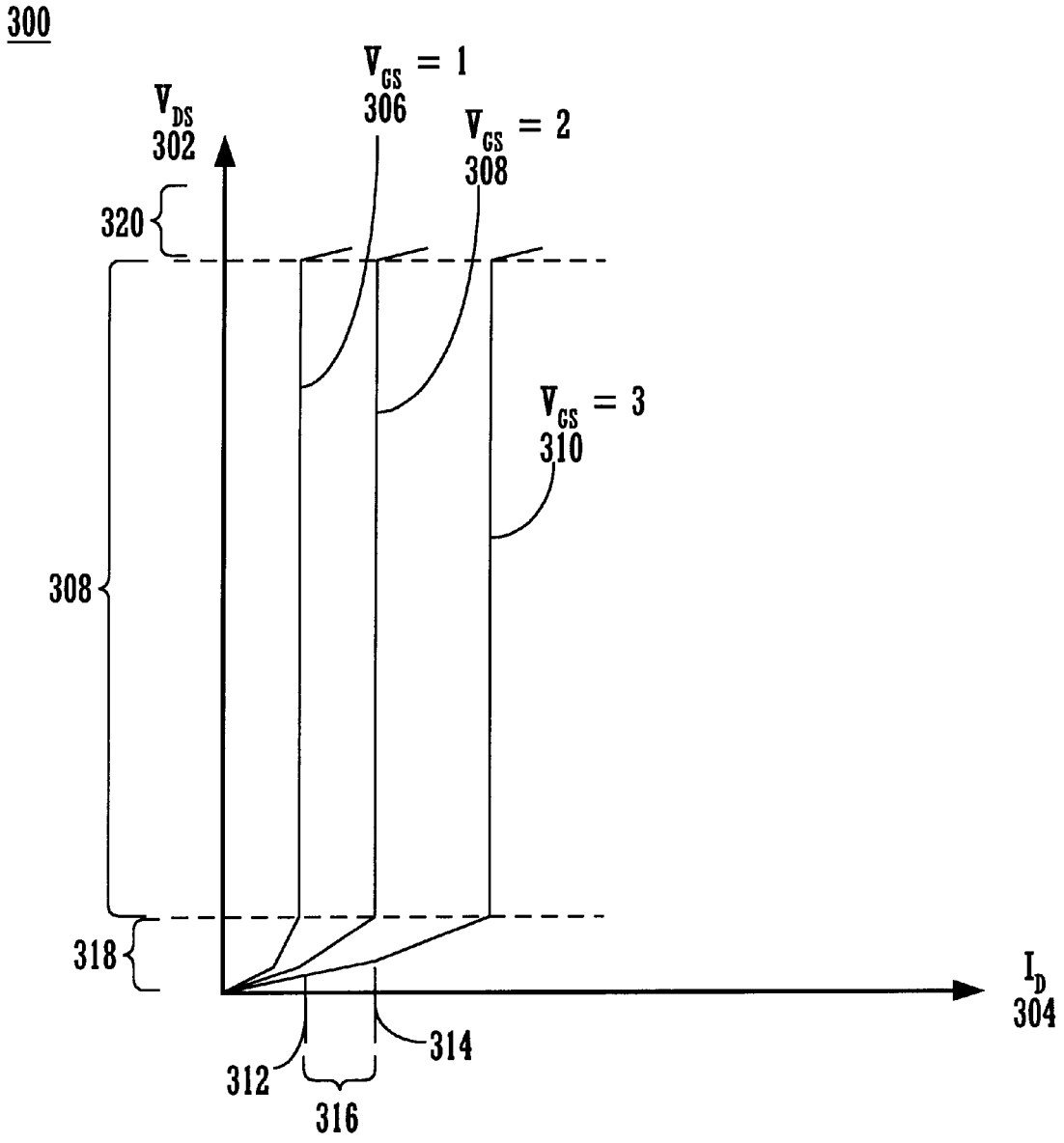
FIG. 3 is a performance curve of a metal oxide semiconductor transistor, in accordance with one aspect of the present invention.

A performance graph 300 of a metal oxide semiconductor transistor is shown in FIG. 3, in accordance with one aspect of the present invention. FIG. 3 shows the horizontal axis as the drain current, $I_D$ 304, that is sunk by a transistor. Drain current $I_D$ 304 is shown as the independent variable in performance graph 300 because drain current $I_D$ 304 is the unknown portion of the signal received at the load device. For example, an upstream component, such as a differential transconductance amplifier, can supply a wide range of currents that the load device must subsequently sink.

Still referring to FIG. 3, performance graph 300 shows the vertical axis as the voltage between the drain and the source of a transistor, $V_{DS}$ 302. This is the motive force that drives current through the transistor after the gate voltage has turned the transistor 'on.' The different gate voltages are shown as a generalized family of curves. More specifically, curve 306 shows the transistor's performance at $V_{GS}$=1 volt. Curve 308 shows the transistor's performance at $V_{GS}$=2 volts. And curve 310 shows the transistor's performance at $V_{GS}$=3 volt. The portion of performance curve 300 where $I_D$ 304 is essentially constant for a wide range of voltages, is referred to as the saturation region 308. Below the saturation region 308 is a region referred to as the ohmic region 318. Above the saturation region 308 is a region referred to as the breakdown region 320. For clarity, voltage levels are shown in the 'volt' range, but could exist in any range, e.g. millivolts.

While FIG. 3 shows one embodiment of specific gate voltages, drain currents, and performance curves, the present invention is well-suited to a wide range of performance values and operational characteristics. For example, other embodiments could utilize performance graphs for any of the alternative transistor configurations, e.g. the alternatives mentioned for FIG. 2A.

Figure 4:
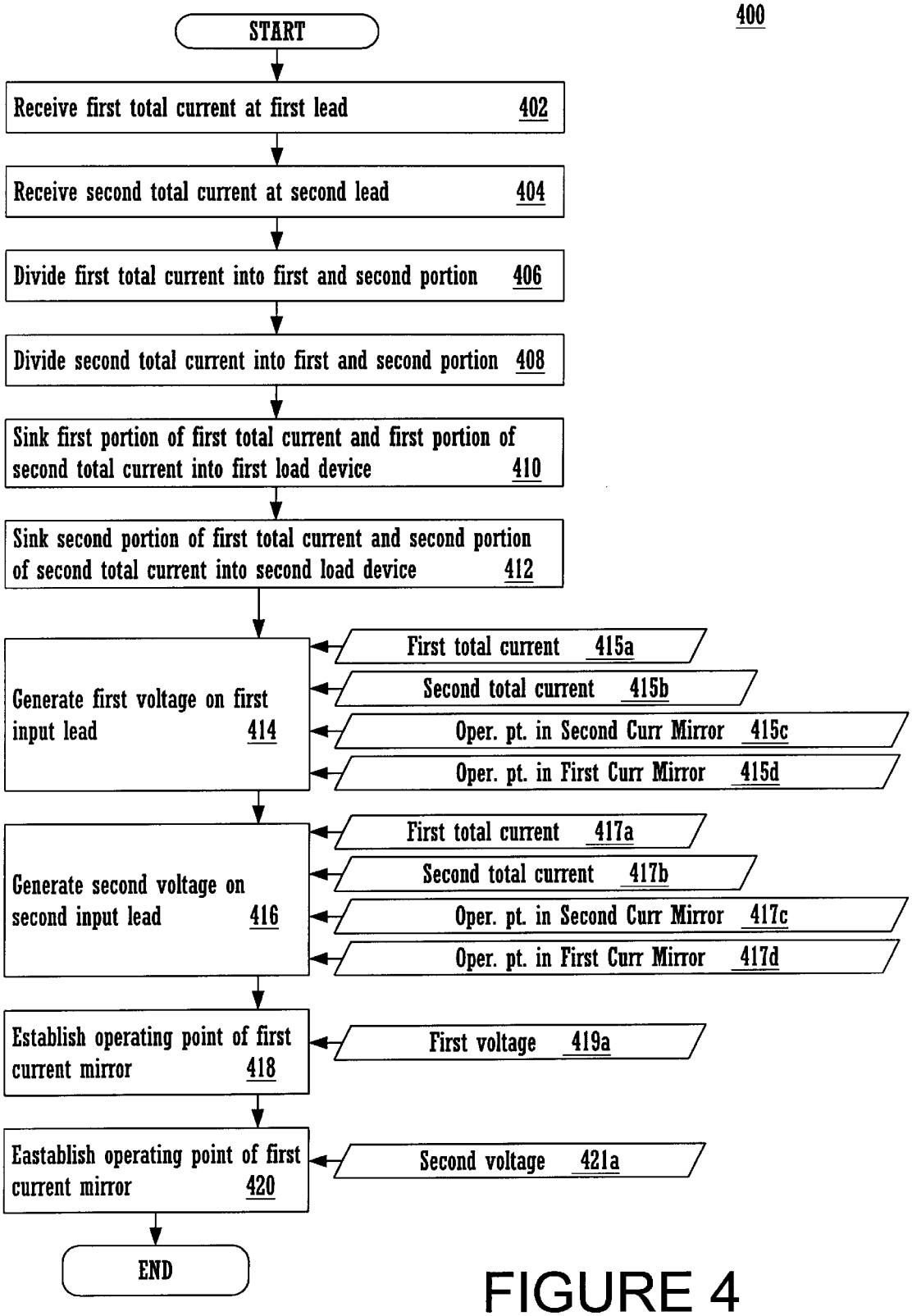
FIG. 4 is a flowchart of the steps performed to provide a high differential impedance load, in accordance with one embodiment of the present invention.

A flowchart of the steps performed to provide a high differential impedance load is shown in FIG. 4, in accordance with one embodiment of the present invention. By using the steps provided in flowchart 400, the present invention provides a stable operating point, maximum gain, and preserves both true and complementary versions of the voltage signal.

In step 402 of the present embodiment, a first total current is received at a first lead. Step 402 is implemented, in one embodiment, as shown in FIG. 2A. First lead 202 is adapted to receive a first signal, having a first total current I1 230. First total current I1 230 can be transmitted from an upstream device, not shown in FIG. 2A, such as a differential transconductance amplifier. The present invention is suitable to receiving a signal from any type of upstream device.

In step 404 of the present embodiment, a second total current is received at a second lead. Step 404 is implemented, in one embodiment, as shown in FIG. 2A. Second lead 204 is adapted to receive a second signal, having a second total current I2 240, transmitted from an upstream device, not shown in FIG. 2A, such as a differential transconductance amplifier. The present invention is suitable for receiving a signal from any type of upstream device.

In step 406 of the present embodiment, first total current is divided into a first and second portion. Step 406 is implemented, in one embodiment, as shown in FIG. 2A. First total current I1 230 is divided into a first portion I1-A 232 and a second portion I1-B 234.

In step 408 of the present embodiment, second total current is divided into a first and second portion. Step 406 is implemented in one embodiment, as shown in FIG. 2A. Second total current I2 240 is divided into a first portion I2-A 244 and into a second portion I2-B 242.

In step 410 of the present embodiment, the first portion of the first total current and the first portion of the second total current are sunk into a first load device. In one embodiment, first load device is a first current mirror. In one embodiment that implements step 410, the first portion of the first total current and the first portion of the second total current are sunk by separate components in first current mirror. FIG. 2A provides one embodiment of step 410. In FIG. 2A, the first portion I1-A 232 of first total current I1 230 is sunk by a diode coupled device, e.g. first transistor 212, in first current mirror 210. Similarly, first portion I2-A 244 of second total current I2 240 is sunk by second transistor 224 in first current mirror 210. While the present embodiment shows a specific path and specific components through which first portion and second portion of first total current flow, the present invention is suitable to using a wide range of devices and/or flow paths to accomplish step 410.

In step 412 of the present embodiment, the second portion of the first total current and the second portion of the second total current are sunk into a second load device. In one embodiment, second load device is a second current mirror. In one embodiment that implements step 412, the second portion of the first total current and the second portion of second total current are sunk by separate components in second current mirror. FIG. 2A shows one embodiment that implements step 412. In FIG. 2A, second portion I2-B 242 of second total current I2 240 is sunk by a diode coupled device, e.g. transistor 222 while second portion I1-B 234 of first total current I1 230 is sunk by second transistor 214. While the present embodiment shows a specific path and components through which first portion and second portion of second total current flow, the present invention is suitable to using a wide range of devices and/or flow paths to accomplish step 412.

In step 414 of the present embodiment, a first voltage is generated on first lead. In one embodiment, first voltage is derived from several inputs, including first total current input 415*a,* second total current input 415*b,* second current mirror operating point input 415*c,* and first current mirror operating point input 415*c.* In one embodiment, second current mirror operating point is generated by a single component within second current mirror, as described hereinafter. Similarly, in one embodiment, first current mirror operating point is generated by a single component within first current mirror, as described hereinafter.

One embodiment that implements step 414 with inputs 415*a*–415*d* is shown in FIG. 2A. In FIG. 2A, inputs 415*a* through 415*d* establish first voltage because they are coupled to, or are transmitted on, first lead 202. More specifically, first total current I1 230 is transmitted on first lead 202 from an upstream device, not shown in FIG. 2A, and so provides first total current input 415*a*. Second total current input 415*b* indirectly affects the first voltage on first lead by flowing through components in first current mirror 210 and second current mirror 220 that are coupled to, or have an effect on, first lead 202. For example, portions of second total current I2 240 flow through transistor 224 and transistor 222 that are coupled to, and have an effect on first input lead 202, e.g. via gate 214*a* and drain 214*b* of transistor 214. Also, second current mirror operating point input 415*c* is provided by coupling drain 214*b* of second transistor 214 of second current mirror 220 to first lead 202. Finally, first current mirror operating point input 415*d* is provided by coupling drain 212*b* and gate 212*a* of first transistor 212 of first current mirror 210 to first lead 202. First voltage can be sensed on first output lead 202*a* of FIG. 2A, in one embodiment. In another embodiment, the first voltage is sensed at the upstream device sourcing current to the load device.

In step 416 of the present embodiment, a second voltage is generated on second lead. In one embodiment, second voltage is derived from several inputs, including first total current input 417*a,* second total current input 417*b,* second current mirror operating point input 417*c,* and first current mirror operating point input 417*d.* In one embodiment, second current mirror operating point is generated by a single component within second current mirror, as described hereinafter. Similarly, in one embodiment, first current mirror operating point is generated by a single component within first current mirror, as described hereinafter.

One embodiment that implements step 416 with inputs 417*a*–417*d* is shown in FIG. 2A. In FIG. 2A, inputs 417*a* through 417*d* establish first voltage because they are coupled to, or are transmitted on, second lead 204. More specifically, first total current input 417*a* indirectly affects the second voltage on second lead by flowing through components in first current mirror 210 and second current mirror 220 that are coupled to, or have an effect on, second input lead 204. For example, portions of first total current I1 230 flow through transistor 212 and transistor 214 that are coupled to, and have an effect on, second input lead 204, e.g. via gate 224*a* of transistor 224. Second total current I2 240 is transmitted on second lead 204 from an upstream device, not shown in FIG. 2A, and so provides second total current input 417*b.* Also, second current mirror operating point input 417*c* is provided by coupling drain 222*b* and gate 222*a* of first transistor 222 in second current mirror 220 to second lead 204. Finally, first current mirror operating point input 415*c* is provided by coupling drain 224*b* of second transistor 224 in first current mirror 210 to second lead 204. In one embodiment, e.g. common-mode operation, values for inputs 415*b*–415*d* of step 414 are the same as the values for inputs 417*b*–417*d* of step 416. Second voltage can be sensed on second output lead 204*a* of FIG. 2A, in one embodiment. In another embodiment, the first voltage is sensed at the upstream device sourcing the current to the load device.

The benefit of symmetrically inter-coupling first current mirror and second current mirror, in the embodiment of flowchart 400 and as implemented in the embodiment of FIG. 2A, is to provide an equivalent current flow through first lead 202 and second lead 204. Thus, the present invention overcomes the prior art drawback of mismatched current levels on the two inputs of the load device. This configuration also preserves the true and complementary versions of the signal on each input lead.

With the load device of the present embodiment, which is designed to provide approximately equivalent current flow for the first and second lead, any difference in current between the two input leads, e.g. as sourced from the differential transconductance amplifier, will generate a significant voltage differential between first lead 202 and second lead 204. Hence, the present invention provides a substantial voltage differential gain for a given differential current input.

In step 418 of the present embodiment, the operating point of the first current mirror is set. In one embodiment, the operating point of the first current mirror is set according to the first voltage input 419*a.* In one embodiment, first voltage input 419*a* is generated in step 414. FIG. 2A shows one embodiment that implements step 418 with input 419*a.* In FIG. 2A, input 419*a* establishes the operating point of the first current mirror 210 because it provides the bias, of first voltage on first lead 202, to gates 212*a* and 224*a* of transistors 212 and 224 respectively, in first current mirror 210.

In step 420 of the present embodiment, the operating point of the second current mirror is established. In one embodiment, the operating point of the second current mirror is established according to the second voltage input 421*a*. In one embodiment, second voltage input 421*a* is generated in step 416. FIG. 2A shows one embodiment that implements step 420 with input 421*a*. In FIG. 2A, input 421*a* establishes the operating point of the second current mirror 220 because it provides the bias, of second voltage on second lead 204, to gates 222*a* and 214*a* of transistors 222 and 214 respectively, in second current mirror 220. As a result of steps 418 and 420, the present invention provides an effective and efficient control mechanism for the load device without using complicated or external circuitry.

The benefit of high differential impedance is best shown by exemplifying the case of receiving differential currents at the load device. This case is referred to as differential operation. If first lead 202 has a much higher current than second lead 204, for example, then the present invention would provide a high differential impedance. The first diode coupled device 212 in the first current mirror 210, shown as first transistor 212, would generate a nominal voltage because its gate 212*b* is tied to its drain 212*c*. Examining only this first diode coupled device, first current mirror 210 only generates a nominal drain voltage, e.g. $V_{DS}$. This is because the gate voltage would rise and allow more current through the transistor in response to the drain voltage rising for an increase in the current level.

However, second transistor 214 in the second current mirror 220 also contributes to the operating point, and the voltage level, of first current mirror 210. Transistor 214 has its gate 214*a* tied to a voltage source that is not its own drain 214*b*. Rather, gate 214*a* is tied to another voltage source, e.g. drain 222*b* of second transistor 222 in second current mirror 220. Hence, as the current level increases in first lead 202, and subsequently in transistor 214, the drain voltage, e.g. $V_{DS}$, will rise because the gate voltage, as supplied by the second current mirror, remains fixed. The gate voltage remains fixed because of the relatively lower current level on second lead 204 provided to first transistor 222. Referring to the performance embodiment shown in FIG. 3, transistor 214 could be represented, in one embodiment, by curve 306 with a $V_{GS}$=1, but with a high current, e.g. in the breakdown region 320. In this example, transistor 214 will generate a relatively high voltage, e.g. $V_{DS,}$ that is supplied to first lead 202.

Still referring to the present example, the increase in voltage on first lead 202, shown in FIG. 2A, is communicated to the gate 212*a* of first transistor 212 in first current mirror 210. With a higher gate voltage, $V_{GS}$, than before, transistor 212 will be able to sink more current than previously for a given $V_{DS}$. Thus, some current will be diverted from second transistor 214 in second current mirror 220. This will lower the voltage level of first lead 202 somewhat. However, the voltage level on first lead 202 will still be high because of the current mismatch on the inputs of the load device.

For the load device as a whole, the process occurs continuously and simultaneously until components in first current mirror 210 and second current mirror 220 have reached equilibrium. In this manner, first voltage on first current mirror 210 will rise or drop and second voltage on second current mirror 220 will drop or rise, depending on the relative current levels on the two input leads, for differential operation. Hence, the present invention provides a true or complementary voltage level on first lead 202 and a complementary or true voltage level on second lead 204, depending on the relative current levels on the two input leads. The example presented herein was chosen for clarity. The present invention is well-suited to a wide range of currents existing on either first lead 202 or second lead 204. In one embodiment, a downstream device can tap the voltage levels from first lead 202 and second lead for subsequent amplification or processing.

In a second case, current levels on first lead and second lead are approximately the same. This is referred to as common-mode operation. In this case, the present invention provides a very stable operating point, for a wide range of currents. This is because the diode coupled devices, in one embodiment of first current mirror 210 and second current mirror 220, self-regulate the operating point of both first current mirror 210 and second current mirror 220. For example, if a current level increases too much, e.g. out of the saturation region 308 of FIG. 3, then the transistor drain voltage, $V_{DS}$, will in crease, e.g. in the breakdown voltage region 320, as shown in FIG. 3. When the drain voltage increases, the gate voltage will also increase and present a new performance curve for the transistor, e.g. gate voltage $V_{GS}$ rises from 1 volt, curve 306 to 2 volts, curve 308. With a higher gate voltage, the transistor will yield a lower drain voltage for a given current level. This process continues until an equilibrium is maintained for an input current level. In this manner, the transistors, configured as diode coupled devices, will provide a very stable operating voltage, e.g. reasonably small variations in output voltage, for a very wide range of approximately equal currents on both input leads. Consequently, the present invention provides a robust and novel method for self-regulation. The stable operating voltage greatly simplifies downstream devices that sense the voltage from the load device.

In summary, the present invention provides a load device, and a method for providing a load, that has a less complicated control circuit to regulate its operating, or bias, point. The present invention also provides a load device, and a method for providing a load, that is sensitive to operating point voltage. Additionally, the present invention provides a load device, and a method for providing a load, that regulates its loading based on the voltage of the inputs to the load device, so as to provide a narrow range of voltage levels for common mode operation. The present invention also provides a load device, and a method for providing a load that maintains a maximum gain while providing a voltage-sensitive load device having a stable operating point. Furthermore, the present invention also provides a load device, and a method for providing a load, with high differential impedance. Finally, the present invention also provides a load device, and a method for providing a load, that has true current matching on both inputs and that preserves both the true and complement version of the voltage differential.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, to thereby enable others skilled in the art best to utilize the invention and various embodiments with various modifications as are suited to the particular use contemplated. It is intended that the scope of the invention be defined by the claims appended hereto and their equivalents.

I claim:

1. An internally-regulated three-terminal load device assembly, said load device assembly comprising:

a first lead operable to receive a first total current;

a second lead operable to receive a second total current;

a first load device connected to said first lead and to said second lead, said first load device operable to sink a first portion of said first total current and a first portion of said second total current, said first load device operable to generate a first voltage on said first lead, and said first load device operable to be internally biased;

a second load device connected to said first load device, connected to said first lead, and connected to said second lead, said second load device operable to sink a second portion of said first total current and a second portion of said second total current, said second load device operable to generate a second voltage on said second lead, said second load device operable to be internally biased, said first voltage and said second voltage having a stable operating point and an approximately equal level when said first total current and said second total current are common-mode, and said first voltage and said second voltage complementary to each other when said first total current and said second total current are differential-mode; and a third lead coupled to said first load device and to said second load device, said third lead operable to receive a reference voltage, wherein said internally-regulated load device assembly does not require additional leads.

2. The load device assembly recited in claim 1 wherein said first load device is a first current mirror.

3. The load device assembly recited in claim 1 wherein said second load device is a second current mirror.

4. The load device assembly recited in claim 1 wherein said first load device comprises:

a diode device, said diode device operable to sink said first portion of said first total current, said diode device operable to contribute to said first voltage on said first lead; and a transistor having a gate, a drain and a source, said transistor coupled to said diode device, said transistor operable to sink said first portion of said second total current, said transistor operable to contribute to said second voltage on said second lead.

5. The load device assembly recited in claim 4 wherein said diode device is a transistor device connected in a diode configuration.

6. The load device assembly recited in claim 1 wherein said second load device comprises:

a diode device, said diode device operable to sink said second portion of said second total current, and said diode device operable to contribute to said second voltage on said second lead; and a transistor having a gate, a drain and a source, said transistor coupled to said diode device, said transistor operable to sink said second portion of said first total current, and said transistor operable to contribute to said first voltage on said first lead.

7. The load device assembly recited in claim 4 wherein said diode device is a transistor device connected in a diode configuration.

8. The load device assembly recited in claim 5, wherein said drain of said diode transistor device is coupled to said first lead, wherein said drain of said transistor is coupled to said second lead, wherein said source of said diode transistor device and said source of said transistor are coupled to said third lead, and wherein said gate of said diode transistor device and said gate of said transistor are coupled to said first lead to receive said first voltage.

9. The load device assembly recited in claim 7, wherein said drain of said diode transistor device is coupled to said second lead, wherein said drain of said transistor is coupled to said first lead, wherein said source of said diode transistor device and said source of said transistor are coupled to said third lead, and wherein said gate of said diode transistor device and said gate of said transistor are coupled to said second lead to receive said second voltage.

10. The load device assembly recited in claim 1 wherein said reference voltage is ground.

11. The load device assembly recited in claim 1 wherein said reference voltage is a power supply voltage.

12. The load device assembly recited in claim 1, wherein said first load device includes at least a first set of cascaded transistors.

13. The load device assembly recited in claim 1, wherein said second load device includes at least a first set of cascaded transistors.

14. A method of providing a high differential impedance and 5stable operating-point load on a first lead connected to an internally-regulated first load device and on a second lead connected to an internally-regulated second load device, said method comprising the steps of:

receiving a first total current at said first lead;

receiving a second total current at said second lead;

dividing said first total current into a first portion and a second portion by said internally-regulated first load device and by said internally-regulated second load device;

dividing said second total current into a first portion and a second portion by said internally-regulated first load device and by said internally-regulated second load device;

sinking said first portion of said first total current and said first portion of said second total current in said first load device; and sinking said second portion of said first total current and said second portion of said second total current in said second load device, said second total current being approximately equivalent to said first total current.

15. The method recited in claim 14, further comprising the steps of:

generating a first voltage at said first lead based on said first total current, said second total current, an operating point of said first load device, and an operating point of said second load device; and generating a second voltage at said second lead based on said first total current, said second total current, said operating point of said first load device, and said operating point of said second load device.

16. The method recited in claim 15, further comprising the steps of:

establishing said operating point of said first load device based on said first voltage; and establishing said operating point of said second load device based on said second voltage.

17. The method recited in claim 14, further comprising the steps of:

sinking said first portion of said first total current into a diode device of said first load device;

sinking said first portion of said second total current into a transistor of said first load device;

sinking said second portion of said second total current into a diode device of said second load device; and sinking said second portion of said first total current into a transistor of said second load device.

18. The method recited in claim 17, further comprising the steps of:

generating said first voltage at said first lead based on said first portion of said first total current sunk into said first diode device of said first load device, based on said second portion of said first total current sunk into said transistor of said second load device, based on an operating point of said first diode device of said first load device, and based on an operating point of said transistor of said second load device; and generating said second voltage at said second lead based on said first portion of said second total current sunk into said transistor of said first load device, based on said second portion of said second total current sunk into said diode device of said second load device, based on an operating point of said transistor of said first load device, and based on an operating point of said diode device of said second load device.

19. The method recited in claim 18, further comprising the steps of:

establishing said operating point of said diode device of said first load device based on said first voltage;

establishing said operating point of said transistor of said first load device based on said first voltage;

establishing said operating point of said diode device of said second load device based on said second voltage; and establishing said operating point of said transistor of said second load device based on said second voltage.

20. A load device assembly, said load device assembly comprising:

a first lead operable to receive a first total current;

a second lead operable to receive a second total current, said first total current approximately equivalent to said second total current;

a first current mirror including a diode device, said first current mirror connected to said first lead and to said second lead, said first current mirror sinking a first portion of said first total current and a first portion of said second total current, said first current mirror operable to contribute to a first voltage on said first lead and to a second voltage on said second lead;

a second current mirror including a diode device, said second current mirror connected to said first current mirror, to said first lead, and to said second lead, said second current mirror sinking a second portion of said first total current and a second portion of said second total current, said second current mirror operable to contribute to said first voltage on said first lead and to said second voltage on said second lead, said second voltage being approximately equal to said first voltage for a common-mode current input, and said second voltage being complementary to said first voltage for a differential-mode current input; and a third lead coupled to said first current mirror and to said second current mirror, said third lead operable to receive a reference voltage, wherein said load device assembly does not require additional leads.

* * * * *